US006071148A

United States Patent [19]

Radliff et al.

[11] Patent Number: 6,071,148

[45] Date of Patent: Jun. 6, 2000

[54] SEAL RETENTION MEMBER

[75] Inventors: David Ray Radliff; William Joseph Garver, both of Harrisburg, Pa.

[73] Assignee: The Whitaker Corporation, Wilmington, Del.

[21] Appl. No.: 09/150,565

[22] Filed: Sep. 10, 1998

Related U.S. Application Data

[60] Provisional application No. 60/060,394, Sep. 30, 1997.

[51] Int. Cl.[7] ..... H01R 13/40

[52] U.S. Cl. ..... 439/587; 439/903

[58] Field of Search ..... 439/589, 274, 439/275, 279, 903

[56] References Cited

U.S. PATENT DOCUMENTS

| | | | |
|---|---|---|---|
| 3,772,637 | 11/1973 | Paullus et al. | 439/589 |
| 3,818,420 | 6/1974 | Barr | 439/261 |
| 4,364,621 | 12/1982 | Janvrin et al. | 439/595 |
| 4,497,531 | 2/1985 | Baker | 439/271 |
| 4,588,242 | 5/1986 | McDowell et al. | 439/589 |
| 4,632,482 | 12/1986 | Punako et al. | 439/587 |
| 4,664,461 | 5/1987 | Schubert et al. | 439/587 |
| 4,713,021 | 12/1987 | Kobler | 439/272 |
| 4,729,743 | 3/1988 | Farrar et al. | 439/276 |
| 4,810,208 | 3/1989 | Hayes et al. | 439/589 |
| 4,850,898 | 7/1989 | Gallusser | 439/595 |
| 5,266,045 | 11/1993 | Yamamoto et al. | 439/275 |
| 5,299,949 | 4/1994 | Fortin | 439/275 |
| 5,485,673 | 1/1996 | Lau | 29/883 |
| 5,607,318 | 3/1997 | Wakata et al. | 439/274 |
| 5,823,811 | 10/1998 | Blanchfield et al. | 439/274 |
| 5,934,938 | 8/1999 | Clark et al. | 439/275 |

FOREIGN PATENT DOCUMENTS

| | | | |
|---|---|---|---|
| 2 655 122 | 5/1991 | France | H01R 13/52 |

*Primary Examiner*—Renee Luebke
*Assistant Examiner*—T. C. Patel

[57] ABSTRACT

This invention provides a seal retention member (21,66) for use in an electrical connector. The seal retention member (21,66) has a plurality of wire receiving passages (37) and a latch arm (90) which forms part of a peripheral surface (86) and part of at least one of the wire receiving passages (37).

15 Claims, 3 Drawing Sheets

SEAL RETENTION MEMBER

This application claims the benefit of U.S. Provisional Application No. 60/060,394, filed Sep. 30, 1997.

FIELD OF THE INVENTION

This invention is related to electrical connectors and more particularly to a retention member for retaining a seal in such connectors.

BACKGROUND OF THE INVENTION

Electrical connectors which are subjected to harsh environments such as outdoor elements or vehicle engine compartments typically have sealing features. These features include a seal at the mating interface between two mating halves such as a plug and socket. In addition, a seal is usually provided at the wire entry end of each mating half, that seals around each wire and covers the open end of the connector housing. Some retention means is necessary to ensure that the seal remains in the open end of the housing and tightly surrounding each wire.

U.S. Pat. No. 5,299,949 by Fortin teaches a plate 28 for retaining a seal 24 where the plate is provided with means suitable for fastening it to the body. One or more lugs 42, snap fasten into holes provided in the body. It can be seen that as the plate is inserted into the housing from the rear opening, either the plate or the housing will need to flex until the plate reaches its snapped in position as shown in FIG. 1.

Another example of such a retention member is shown by Yamamoto et al. in U.S. Pat. No. 5,266,045, which teaches a plug holder 29 which is insertable into an opening 23 so that engaging portions 25A and 25B retain the holder 29 and the seals in the opening 23. In this case it can be seen that the housing will be required to flex as the holder is inserted therein until it is in a latched position.

A problem exists when trying to apply the sealed retention methods shown by Fortin and Yamamoto et al. to a high density circular connector. Insertion of the retention member requires one or more walls of the housing to flex outwardly to receive the latching features of the plate. Because a circular housing comprises one continuous wall which does not readily flex outwardly, the housing may have a tendency to crack upon insertion of the retention member. This usually occurs as the latching features on the plate are urged into the housing.

SUMMARY OF THE INVENTION

It is therefore an object of the current invention to provide a seal retention member which does not cause damage to an electrical connector housing upon insertion.

This and other objects have been achieved by providing a retention member for insertion into an electrical connector housing having a plurality of latching openings formed in a peripheral wall. The retention member is profiled to have a plurality of wire receiving openings passing through the plate and at least one latching projection extending from a peripheral surface of the plate. A slot is formed in the plate between the peripheral surface and at least one of the wire receiving openings.

BRIEF DESCRIPTION OF THE DRAWINGS

The invention will now be described by way of example with reference to the accompanying figures, in which.

DETAILED DESCRIPTION OF THE EMBODIMENT

Figure 1:
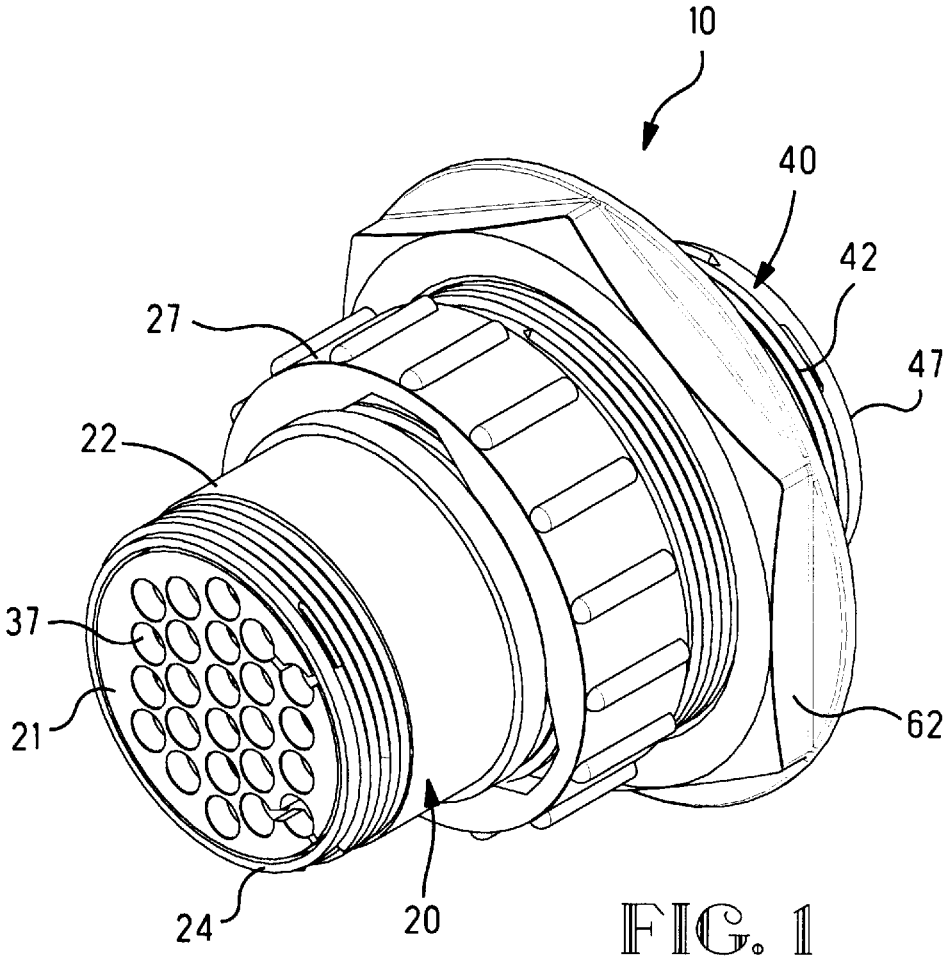
FIG. 1 shows an isometric view of the electrical connector system according to the present invention.
Figures 2, 4:
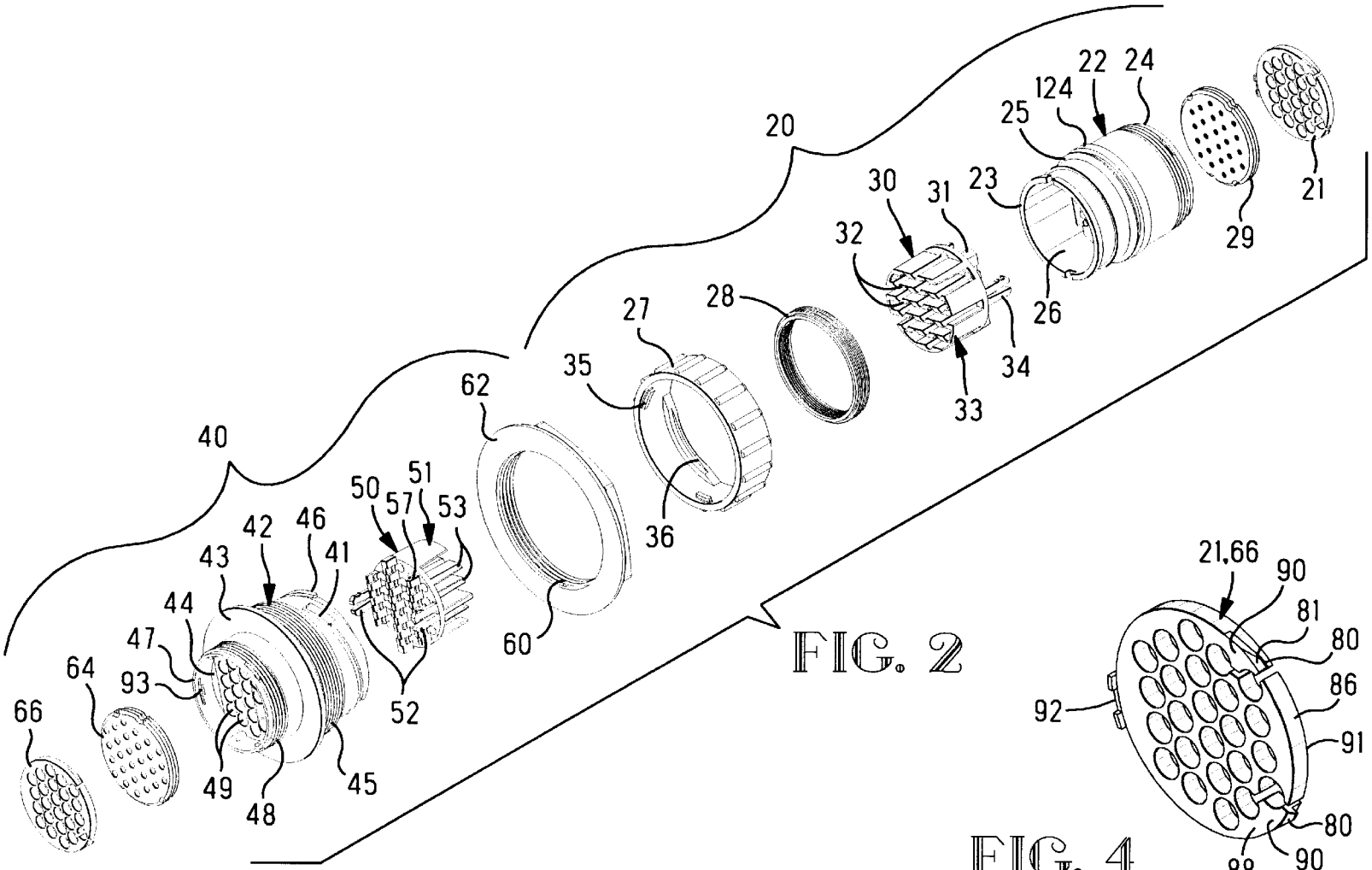
FIG. 2 shows an isometric exploded view of the connector system of FIG. 1.
FIG. 4 shows an isometric view of the retention member of FIG. 3.

The invention will first be described generally with reference to FIGS. 1 and 2. An electrical connector arrangement (10) is shown here in a mated condition and consists of a plug connector (20) which is made matable with a receptacle connector (40). The plug connector (20) has an insulative plug housing (22) with a wire receiving end (24) which receives a seal (29) and a retention member (21). The retention member (21) has a plurality of openings (37) for receiving terminated wires into cavities of the plug housing (22). A coupling ring (27) surrounds the plug housing (22) at it's mating end (23). The coupling ring (27) is free to rotate about the plug housing (22) and has a threading portion (35) on its interior surface for receiving the receptacle connector (40).

The receptacle connector (40) is profiled to be mounted to a panel and features a receptacle housing (42) having a wire receiving end (47) which is similar to that of the plug housing (22). A shoulder (43) is formed around the receptacle housing (42). A jam nut (62) is threadable to the receptacle housing (42) and is shown engaging the shoulder (43), and would secure the panel's cutout periphery between itself and shoulder 43.

Figure 6:
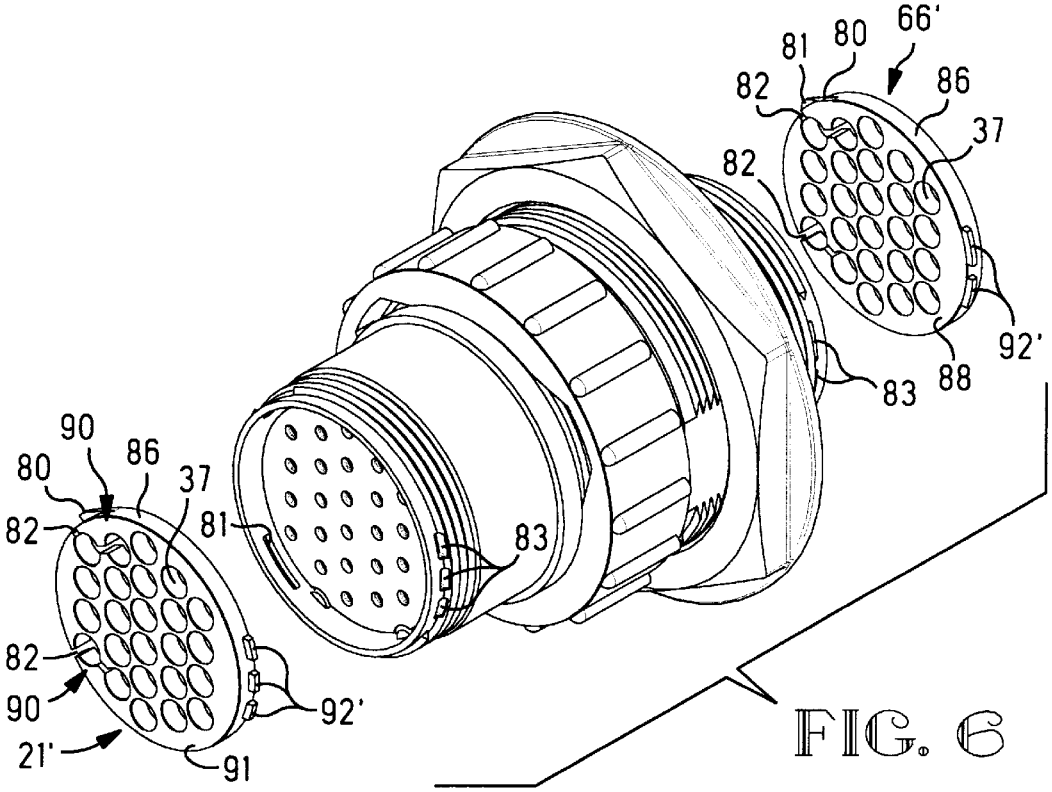
FIG. 6 shows an isometric view similar to that of FIG. 1 with a pair of alternate retention members exploded out.

Each of the major components will now be described in greater detail with reference to FIG. 2. Plug connector (20) features an insulative plug housing (22) which is generally cylindrically shaped and has a wire receiving end (24) and a mating end (23). A terminal receiving area (26) is located inside the insulative plug housing (22). The terminal receiving area has a plurality of terminal receiving passages which extend therethrough. These passages are the same as those in the receptacle connector (40) and will be described in greater detail below. A shoulder (124) is disposed around the outside of the insulative plug housing (22) near its center and a ring locking shoulder (25) is disposed adjacent to shoulder (124). Latching and locking openings (81,83) are provided at the wire receiving end (24) (FIG. 6).

Also at the wire receiving end (24), a wire entry seal (29) is received inside a large recess in the connector. A retention member (21) locks into the plug housing (22) at the wire receiving end (24) and serves to retain the wire entry seal (29). A mating seal (28) is profiled to fit around plug housing (22) forwardly of ring locking shoulder (25) proximate the mating end (23). A coupling ring (27) features a locking projection (36) which fits in between the ring locking shoulder (25) and the shoulder (124). Threading projections (35) are also located along the interior surface of the coupling ring (27). A secondary lock member (30) is profiled to fit inside the terminal receiving area (26) and features a series of locking projections (31) on a first side along with latch arms (34) extending adjacent to the locking projections (31).

Figure 5:
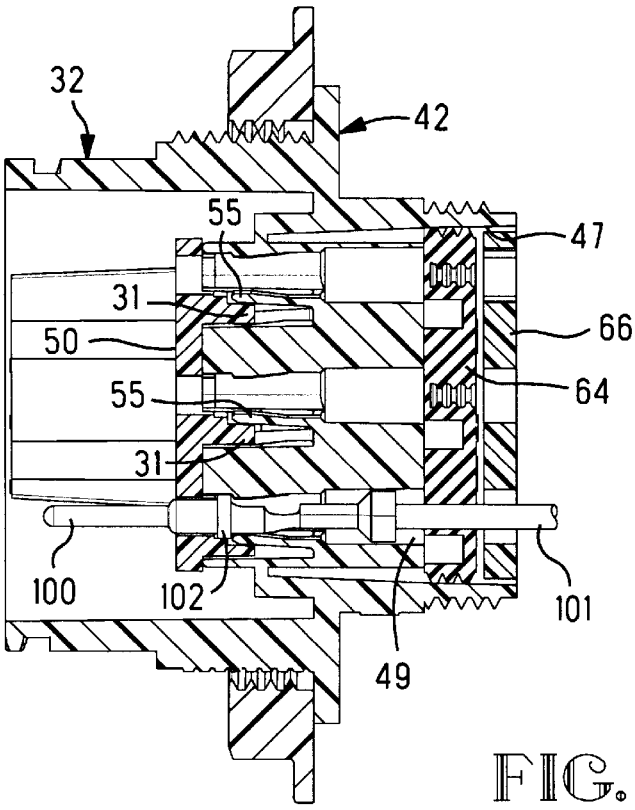
FIG. 5 shows a cross-sectional view of the receptacle connector shown in FIGS. 1 and 2.

The receptacle connector (40) includes an insulative receptacle housing (42) having a shoulder (43), a threaded portion (45) disposed adjacent to shoulder (43) and a second threaded portion (41) around the receptacle housing (42) near the mating end (46). A similar wire entry seal (64) and retention member (66) are disposed inside a large recess near the wire receiving end (47). A jam nut (62) is profiled to have a threaded section (60) on its interior surface which is received by the threads (45) on the housing. A complementary secondary lock member (50) features similar latching arms (52) and a plurality of keying projections (53) on a shroud portion (51), and locking projections (57) for the terminals similarly to locking projections (31). The terminal receiving area is designed similar to that of the plug (20) and features a plurality of terminal receiving passages (49) extending from the wire receiving end (47) toward the mating end (46). The inside of these passages can be best seen in FIG. 5. The passages (49) are profiled to each have a latching finger extending from a wall toward the mating end (46). The latching fingers (55) are resilient to allow terminal insertion and latch behind a shoulder (102) of each terminal (100).

The retention member (21) will now be described in greater detail with respect to FIGS. 3 and 4. It should be understood that the retention members (21) and (66) shown in FIG. 2 are similar and therefore the following description will apply to both. The two structures are the same except that the numbering designations of the wire passages (37) are mirror images of each other and the retention members (21,66) are keyed accordingly. A detailed description of these differences will follow.

Figure 3:
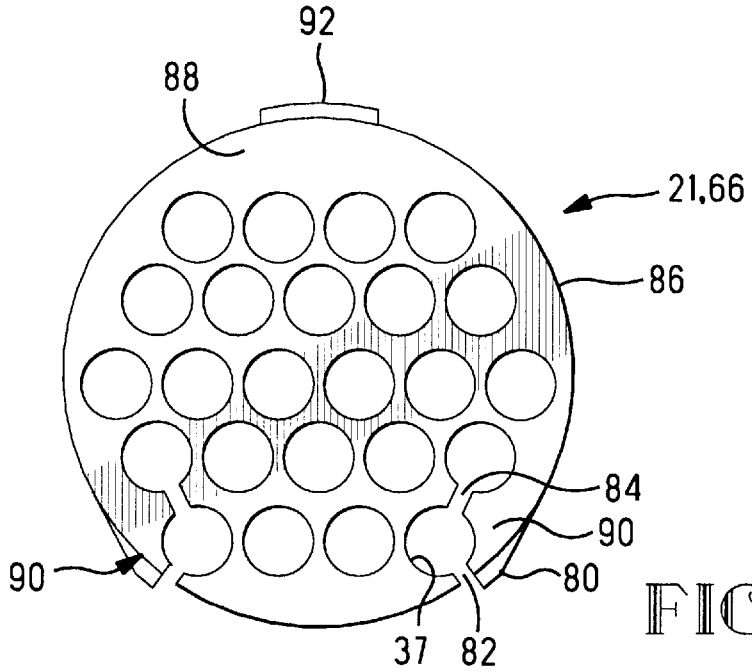
FIG. 3 shows a front view of a retention member according to the present invention.

Referring first to FIG. 3, the retention member (21) is formed of a flat plate and has a peripheral surface (86), a first major surface (88) and a second major surface (91) which is opposite the first major surface (88). The peripheral surface (86) extends between the major surfaces (88,91). A plurality of wire receiving passages (37) extend between the major surfaces (88,91) and within the peripheral surface (86). Latching projections (80) extend from the peripheral surface (86) and are profiled to have a lead-in surface (81) as can be best seen in FIG. 4. A locking projection (92) extends from the peripheral surface (86) generally opposite the latching projections (80). The locking projection extends from the first major surface (88) at a right angle. This locking projection (92) and is associated with a corresponding slot (93) in the housing (FIG. 2), and serves as a hook during the assembly process which will be described below.

An alternate design for the locking projection is shown on retention members (21',66') in FIG. 6. The alternate arrangement of locking projections (92') extends parallel to the first major surface (88) instead of perpendicular. FIG. 6 also shows how these locking projections (92') can be arranged to key the retention members (21',66') to the appropriate housing. There are three locking projections (92') which are keyed to the plug housing (22) by three slots (83) so that the wire number designations are positioned next to the appropriate wire receiving passages (37). The retention member (66') however has only two locking projections (92') which are each slightly larger and keyed to the receptacle housing (42) by two slots (83) for a similar purpose.

Referring back to FIGS. 3 and 4, a slot (82) extends from the peripheral surface (86) into one of the wire receiving passages (37), such that a resilient latch arm (90) is defined that includes projection (80) and defines a portion of the periphery of passage (37). Also shown is another slot (84) that extends from the passage (37) to an adjacent wire receiving passage, thus increasing the effective length of the latch arm. It should be noted here that while this embodiment shows one slot (82) cut into the peripheral surface (86) and another slot (84) extending between adjacent wire receiving passages (37), depending on the flexibility required for the application, slot (84) may not be necessary, or contrarily, additional slots may be cut between more of the wire receiving passages (37) to achieve a different shaped latch arm (90) having different spring characteristics, such as where the retention member is relatively thick or the diameter of passages (37) is relatively small.

Assembly of the retention member to a connector in accordance with the present invention, will now be described in greater detail with reference to FIGS. 2 and 6. First, the projections (92') are aligned with the slots (83) and inserted therein at an angle. Next, the retention member is urged into the terminal receiving area (26) such that the lead-in surfaces (81) engage the housing wall. As the retention member is urged further into the housing, the latch arms (90) will be urged inward toward each other by the force applied on the lead-in surfaces (81). When the retention member has been urged into the housing such that the latching projections (80) are aligned with slots, the latching arms (90) will resile back to their original position causing the latching projections (80) to snap into the slots (81) thus securing the retention member to the housing.

The advantage of the present invention is that the retention member has resilient latching arms which prevent damage to the housing upon insertion.

While the foregoing has been provided with reference to the embodiment, various changes within the sprit of the invention will be apparent to those reasonably skilled in the art. For example, the locking projections (92,92') can be formed in other shapes to serve the same purpose. Also, the latching projections can be varied in shape or number to achieve different keying arrangements. Thus, the invention should be considered as limited only by the scope of the claims.

What is claimed is:

1. An electrical connector having a housing for receiving a wire seal, the electrical connector comprising:

a seal retention member formed as a flat plate having opposite major surfaces that define respective planes, a plurality of wire receiving passages extending between the opposite major surfaces, a peripheral surface extending between the opposite major surfaces, at least one latching projection extending from the peripheral surface and disposed between the planes, and a first slot extending from the peripheral surface into one of the wire receiving passages, thereby defining a resilient latch arm disposed between the planes, wherein the at least one latching projection is disposed on the resilient latch arm for deflection in a directon parallel to the planes.

2. The electrical connector as recited in claim 1 wherein the seal retention member further comprises a locking projection extending from the peripheral surface at a location spaced apart from the latching projection.

3. The electrical connector as recited in claim 1 wherein the housing has at least one opening for receiving the at least one latching projection.

4. The electrical connector as recited in claim 1 wherein the at least one latching projection has a lead-in surface.

5. The electrical connector as recited in claim 1 wherein the seal retention member further comprises a second slot extending between adjacent wire receiving passages.

6. A retention member for use in an electrical connector having a housing for receiving the retention member, the housing having a wall surrounding the retention member with latching openings formed in the wall, the retention member comprising:

a flat plate having opposite major surfaces that define respective planes, a plurality of wire receiving openings formed in the plate, the wire receiving openings being profiled to receive wires terminated to terminals, at least one latching projection extending from a periphery of the plate and disposed between the planes, and;

at least one slot formed in the plate between at least two of the wire receiving openings, thereby defining a resilient latch arm disposed between the planes, wherein the at least one latching projection is disposed on the resilient latch arm for deflection in a direction parallel to the planes.

7. The retention plate as recited in claim 6 wherein the slot is located adjacent the periphery of the plate.

8. The retention plate as recited in claim 7 wherein the slot is located adjacent the at least one latching projection.

9. The retention plate as recited in claim 6 wherein the at least one latching projection further comprises a lead-in surface being angled from the periphery.

10. The retention plate as recited in claim 6 further comprising a locking projection extending from the peripheral surface generally opposite the latching projection.

11. A seal retainer for an electrical connector, the retainer being formed as a flat plate having a first major surface and a second major surface defining respective planes, a peripheral surface extending between the major surfaces, and a plurality of wire receiving passages extending between the major surfaces, the retainer comprising:

at least on latching projection extending outward from the peripheral surface and disposed between the planes, and at least one slot extending between the major surfaces and from the peripheral surface into one of the wire receiving passages, thereby defining a resilient latch arm disposed between the planes, wherein the at least one latching projection is disposed on the resilient latch arm for deflection in a direction parallel to the planes.

12. The retainer as recited in claim 11 wherein the latching projection is located adjacent to the slot on the peripheral surface.

13. The retainer as recited in claim 11 wherein the latching projection has a lead-in surface which is angled from the first major surface.

14. The retainer as recited in claim 11 further comprising at least one locking projection extending from the peripheral surface generally opposite the latching projection.

15. The retainer as recited in claim 11 further comprising a second slot extending between adjacent ones of the wire receiving passages.

* * * * *